US009399282B1

(12) United States Patent
Schneider

(10) Patent No.: US 9,399,282 B1
(45) Date of Patent: Jul. 26, 2016

(54) TWO-HANDED SPOON SYSTEMS

(71) Applicant: Melissa Schneider, Wapakoneta, OH (US)

(72) Inventor: Melissa Schneider, Wapakoneta, OH (US)

( * ) Notice: Subject to any disclaimer, the term of this patent is extended or adjusted under 35 U.S.C. 154(b) by 76 days.

(21) Appl. No.: 14/248,305

(22) Filed: Apr. 8, 2014

Related U.S. Application Data

(60) Provisional application No. 61/810,295, filed on Apr. 10, 2013.

(51) Int. Cl.
*A47G 21/04* (2006.01)
*B25G 1/10* (2006.01)
*A47G 21/00* (2006.01)

(52) U.S. Cl.
CPC ..... *B25G 1/102* (2013.01); *A47G 21/00* (2013.01); *A47G 21/04* (2013.01)

(58) Field of Classification Search
CPC ..... A47G 21/00; A47G 21/04; B25G 1/102
USPC ..... 30/323, 327, 123, 296.1
See application file for complete search history.

(56) References Cited

U.S. PATENT DOCUMENTS

| | | | | | |
|---|---|---|---|---|---|
| 2,751,683 | A | | 6/1956 | Johns | |
| 4,325,187 | A | * | 4/1982 | Wasson | A47G 21/08 294/25 |
| 4,389,777 | A | | 6/1983 | Landsberger | |
| 4,821,417 | A | | 4/1989 | Levine | |
| 5,075,975 | A | | 12/1991 | Wilson | |
| 5,131,151 | A | * | 7/1992 | Agase | A47G 21/02 224/220 |
| 5,156,429 | A | * | 10/1992 | Adams | B25F 5/021 16/422 |
| 6,141,815 | A | * | 11/2000 | Harrison | A46B 5/00 15/145 |
| 6,457,238 | B1 | | 10/2002 | Maier et al. | |
| 8,468,700 | B2 | * | 6/2013 | Wilson | A47G 21/08 30/123 |
| 2003/0033023 | A1 | * | 2/2003 | McCrae | A47G 21/08 623/65 |

FOREIGN PATENT DOCUMENTS

| | | | |
|---|---|---|---|
| GB | 2 352 613 A | * | 2/2001 |
| GB | 2 352 614 A | * | 2/2001 |
| WO | WO 02/078495 A1 | * | 10/2002 |
| WO | WO 2012/002889 A1 | * | 1/2012 |

* cited by examiner

*Primary Examiner* — Hwei C Payer
(74) *Attorney, Agent, or Firm* — RG Patent Consulting, LLC; Rachel Gilboy

(57) ABSTRACT

A cylindrical handle extender removably-coupleable to a utensil system includes a cylindrical handle extender assembly comprising a cylindrical extender member having a first end; a second end; a radial slit along a length of the cylindrical member, the cylindrical member with an inner-volume defined by an interior surface, the cylindrical member able to be removably-coupled repeatedly to and from the handle of a utensil; a first end cap; and a second end cap. The cylindrical handle extender is removably-coupleable to a utensil system comprises the cylindrical handle extender removably-coupleable to a utensil assembly. The cylindrical extender member provides a large surface area and gripping surface laterally-positionable to a mouth of the user, comfortably positioning for the user who is handicapped.

14 Claims, 5 Drawing Sheets

TWO-HANDED SPOON SYSTEMS

CROSS-REFERENCE TO RELATED APPLICATION

The present application is related to and claims priority from prior provisional application Ser. No. 61/810,295, filed Apr. 10, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of utensils and more specifically relates to a cylindrical handle extender removably-coupleable to a utensil system for assisting a user who has a difficult time gripping or using a traditional utensil.

2. DESCRIPTION OF THE RELATED ART

A kitchen utensil is a hand-held, typically small tool or utensil that is used in the kitchen, for food-related functions. A cooking utensil is a utensil used in the kitchen for cooking; a category of tools of eating utensils, which are tools used for eating. Some utensils are both kitchen utensils and eating utensils and can be used for both food preparation in a kitchen and as eating utensils when dining Other cutlery such as forks and spoons are both kitchen and eating utensils.

Unfortunately, it may prove difficult for people with hand and arm deformities or other conditions to use standard silverware and utensils without help from others. Not only can this be frustrating and a hassle, but it can also affect people's self-esteem and sense of independence. Additionally, children with deformities may be separated at school during lunch, which can make them feel isolated and embarrassed. It is desirable the all individuals be permitted to use utensils in some form.

Various attempts have been made to solve problems found in utensils for handicapped users device art. Among these are found in U.S. Pat. Nos. 5,075,975, 4,821,417, 6,457,238, 4,389,777, and 2,751,683. This prior art is representative of utensils for handicapped users devices. None of the above inventions and patents, taken either singly or in combination, is seen to describe the invention as claimed.

Ideally, a cylindrical handle extender removably-coupleable to a utensil should be user-friendly and safe in-use and, yet would operate reliably and be manufactured at a modest expense. Thus, a need exists for a cylindrical handle extender removably-coupleable to a utensil for assisting a user who has a difficult time gripping or using a traditional utensil.

BRIEF SUMMARY OF THE INVENTION

In view of the foregoing disadvantages inherent in the known utensils for handicapped users device art, the present invention provides a novel cylindrical handle extender removably-coupleable to a utensil (entitled Two-Handed Spoon System). The general purpose of the present invention, which will be described subsequently in greater detail is to provide a cylindrical handle extender removably-coupleable to a utensil for assisting a user who has a difficult time gripping or using a traditional utensil.

A cylindrical handle extender removably-coupleable to a utensil is disclosed herein preferably comprising: a cylindrical handle extender assembly comprising a cylindrical extender member having a first end; a second end; a radial slit along a length of the cylindrical member, the cylindrical member with an inner-volume defined by an interior surface, the cylindrical member able to be removably-coupled repeatedly to and from the handle of a utensil; a first end cap; and a second end cap. The cylindrical handle extender is removably-coupleable to a utensil comprising the cylindrical handle extender removably-coupleable to a utensil. The utensil comprises a spoon or other such utensil. The cylindrical handle extender assembly is washable and re-useable. The cylindrical extender member provides a large surface area and gripping surface laterally-positionable to a mouth of the user, comfortably positioning for the user who is handicapped. The cylindrical extender member enables a user to grasp the utensil laterally with the first hand and the second hand and is as such suitable for use by the users who suffer from disabilities wherein grip strength of the first hand and the second hand are diminished and/or poorly coordinated.

The cylindrical member is resilient to contour to a first hand and a second hand of the user while grasping the cylindrical member in an in-use condition. The cylindrical extender member may comprise rubber. The cylindrical member is removably-coupleably to the handle of the utensil via placement in the (radial) slit. The handle of the utensil is dimensioned to fit into the radial slit and is temporarily secured in place thereby limiting unwanted displacement via friction fitting. The radial slit is able to deform to an aperture through cylindrical extender member to permit the handle of the utensil to fit through the radial slit and temporarily be secured approximately halfway down the handle or as desired.

The first end cap is removably-coupleable to the first end to provide a smooth surface for a first hand of the user to grasp the cylindrical handle extender assembly. The first end cap is circular-shaped to provide hand-contouring of the first hand and the second hand while in the in-use condition for ease of use. The second end cap is removably-coupleable to the second end to provide a smooth surface for a second hand of the user to grasp the cylindrical handle extender assembly. The second end cap is circular-shaped to provide hand-contouring of the first hand and the second hand while in the in-use condition.

Certain embodiments may comprise a one-piece construction wherein utensil(s) are not removable; rather the utensil is integral as a two-handed spoon for example.

A kit is also embodied herein for the cylindrical handle extender removably-coupleable to a utensil comprising: a plurality of cylindrical handle extender assemblies in various colors, designs, lengths, and having various sized radial slits; and a set of user-instructions.

A method of use for a cylindrical handle extender removably-coupleable to a utensil is disclosed herein and comprises the steps of: a user choosing a cylindrical handle extender assembly; the user selecting a utensil to be used; inserting a handle of the utensil through the radial slit thereby temporarily securing the cylindrical handle extender assembly in place; gripping the cylindrical handle extender assembly with at least one hand; the user scooping up at least one food item; the user depositing the at least one food item into a mouth region; removing the cylindrical handle extender assembly from the handle of the utensil once finished for future use; and washing the cylindrical handle extender assembly for a future use.

The present invention holds significant improvements and serves as a cylindrical handle extender removably-coupleable to a utensil. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, cylindrical handle extender removably-coupleable to a utensil (Two-Handed Spoon System), constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a utensil for handicapped users device and more particularly to a cylindrical handle extender removably-coupleable to a utensil (Two-Handed Spoon System) for assisting a user who has a difficult time gripping or using a traditional utensil.

Generally speaking, the two-handed spoon offers people with hand and arm deformities or people with other various conditions a convenient and simple way to feed themselves with one or two hands. This innovative product may comprise a horizontal tube, made of rubber, hard plastic, or other suitable material. At either end of the tube can be comfortable gripping assemblies, such as round or square knobs. Through the center of the tube can be a horizontal slit to perpendicularly insert a spoon.

To use, people can insert a spoon or other utensil into the slit. Then, gripping one or both sides of the tube, a user can scoop up their food and deposit it in their mouth. The length of the spoon may vary to accommodate all people. The size of the gripping assemblies on the ends may also be offered in different sizes as needed.

Figure 1:
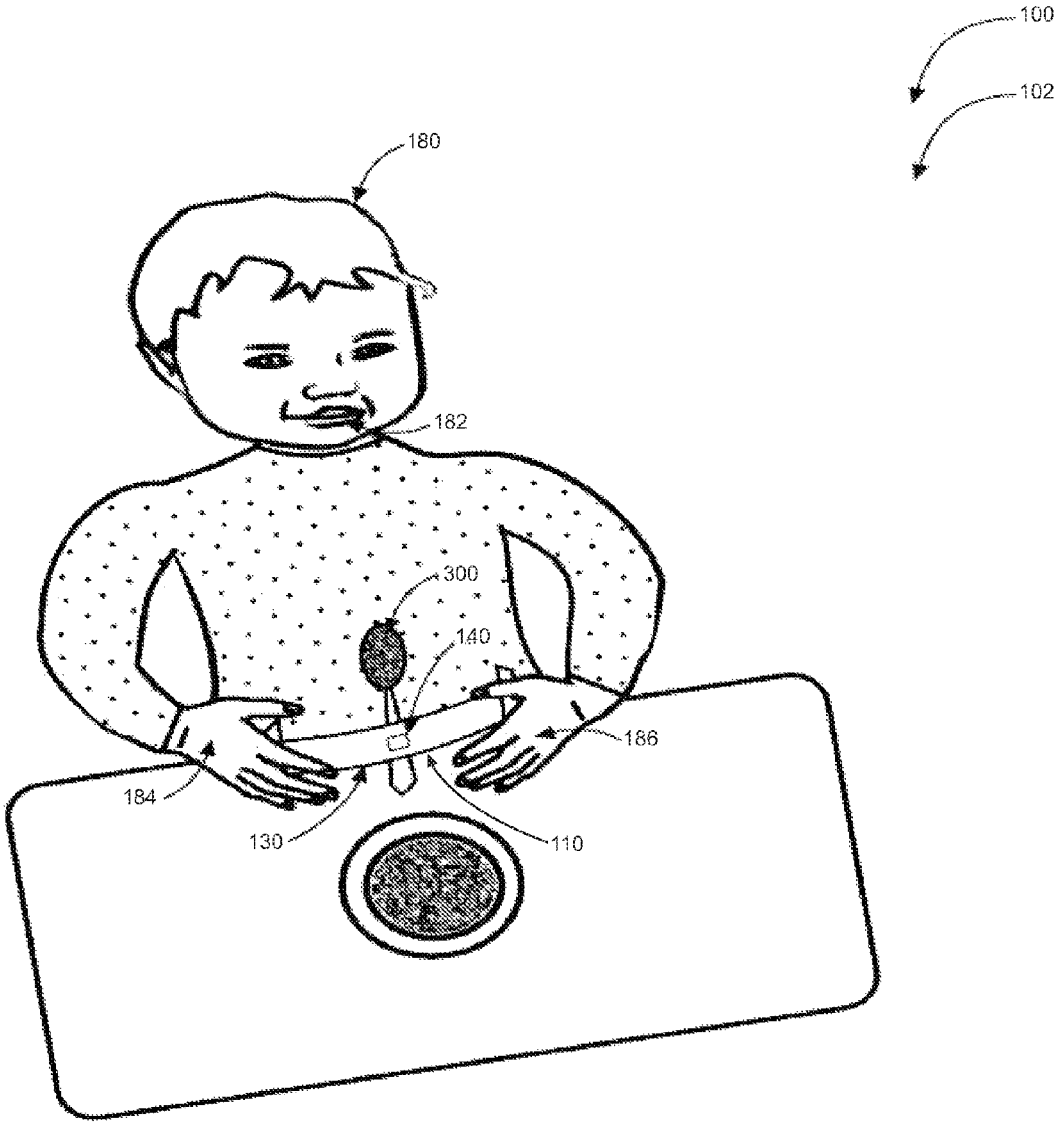
FIG. 1 shows a perspective view illustrating a cylindrical handle extender removably-coupleable to a utensil in an in-use condition according to an embodiment of the present invention.
Figure 2:
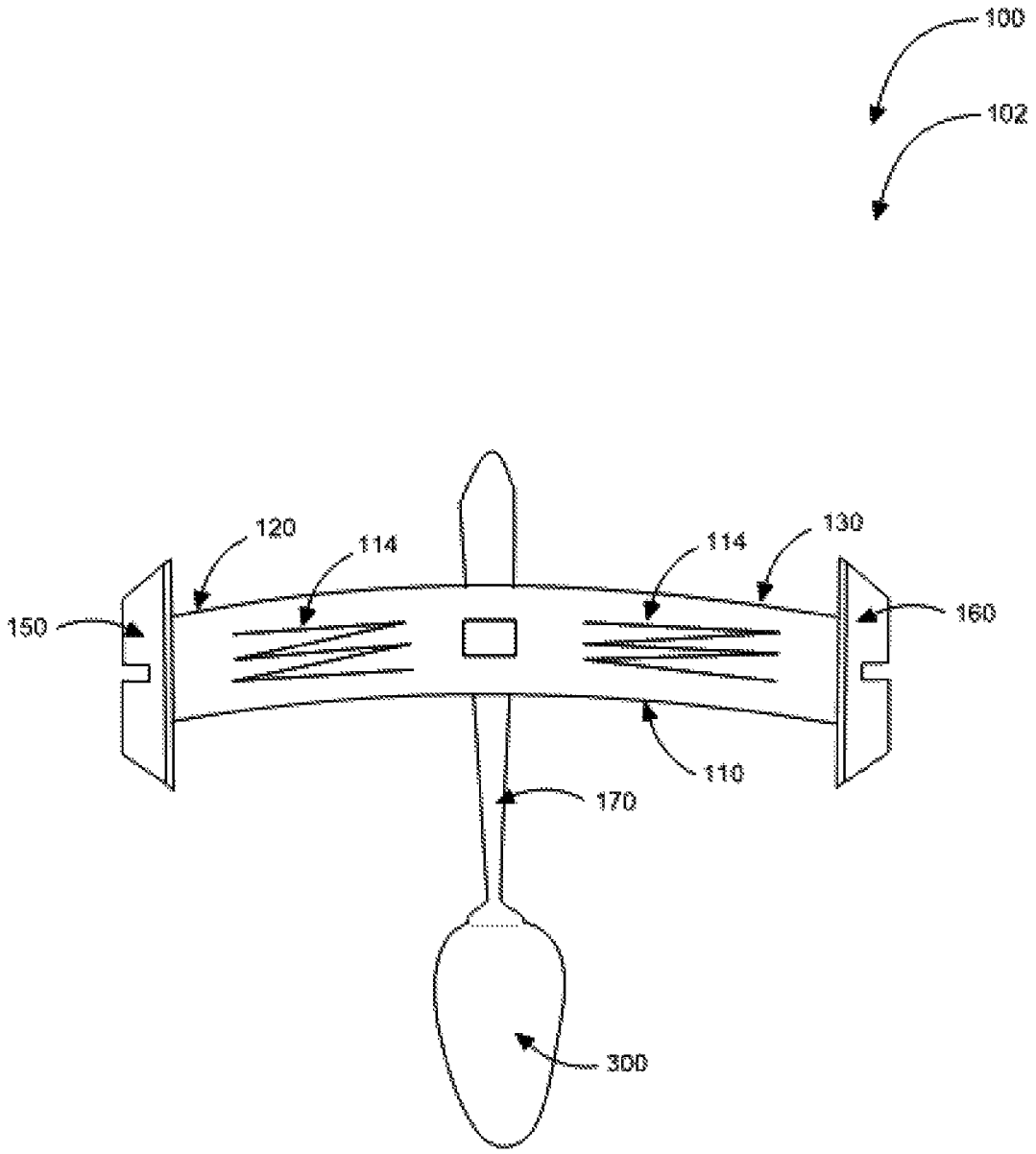
FIG. 2 is a perspective view illustrating a cylindrical handle extender assembly of the cylindrical handle extender removably-coupleable to the utensil according to an embodiment of the present invention of FIG. 1.

Referring to the drawings by numerals of reference there is shown in FIGS. 1 & 2 illustrating cylindrical handle extender assembly 102 of cylindrical handle extender removably-coupleable to a utensil system 100 according to an embodiment of the present invention.

Cylindrical handle extender removably-coupleable to a utensil system 100 in a preferred embodiment comprises: cylindrical handle extender assembly 102 including cylindrical extender member 110 having first end 120; second end 130; radial slit 140 along a length of the cylindrical extender member 110, cylindrical extender member 110 with an inner-volume defined by interior surface 114, cylindrical extender member 110 able to be removably-coupled repeatedly to and from handle 174 of utensil 170; first end cap 150; and second end cap 160. Cylindrical handle extender removably-coupleable to a utensil system 100 preferably comprises cylindrical handle extender removably-coupleable to a utensil 170.

Cylindrical extender member 110 preferably provides a large surface area and gripping surface laterally-positionable to mouth 182 of a user 180, comfortably positioning for the user 180 who is handicapped or otherwise. Cylindrical extender member 110 enables user 180 to grasp utensil 170 laterally with first hand 184 and second hand 186 and is as such suitable for use by user(s) 180 who suffer from disabilities wherein grip strength of first hand 184 and second hand 186 are diminished and poorly coordinated as shown in in-use condition in FIG. 1.

In some embodiments cylindrical handle extender assembly 102 may be disposable. In preferred embodiments cylindrical handle extender assembly 102 is washable and re-useable. When cylindrical handle cover assembly 102 is re-usable, cylindrical handle cover assembly 102 may comprise hard plastic for suitable strength and durability.

Cylindrical extender member 110 may be resilient to contour to first hand 184 and second hand 186 of user 180 while grasping cylindrical extender member 110 in in-use condition. Cylindrical extender member 110 may comprises rubber. When cylindrical handle extender assembly 102 comprises rubber, rubber may include but is not limited to nitrile rubber tubing. Cylindrical extender member 110 is removably-coupleably to handle 174 of utensil 170 via placement radial slit 140. Handle 174 of utensil 170 is dimensioned to fit the radial slit 140 and is temporarily secured in place thereby limiting unwanted displacement via friction fitting. Radial slit 140 is able to deform to an aperture through cylindrical extender member 110 to permit handle 174 of utensil 170 to fit through radial slit 140 and temporarily be secured approximately halfway down handle 174.

Figure 3A:
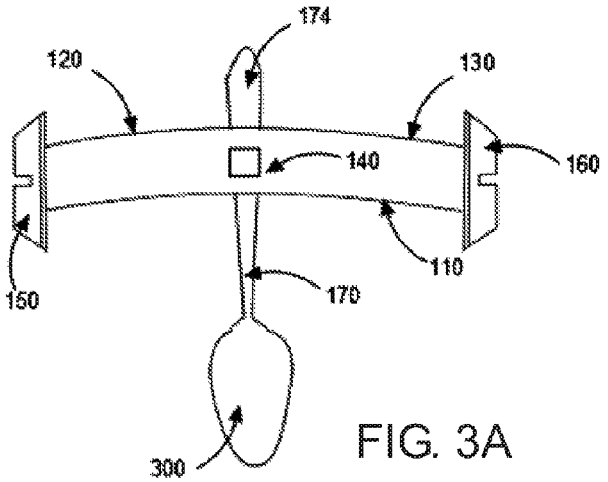
FIG. 3A is a perspective view illustrating a cylindrical handle extender assembly coupled to a handle of a spoon of the cylindrical handle extender removably-coupleable to the utensil according to an embodiment of the present invention of FIGS. 1 and 2.
Figure 3B:
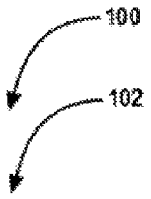
FIG. 3B is a perspective view illustrating a cylindrical handle extender assembly coupled to a handle of a fork of the cylindrical handle extender removably-coupleable to the utensil according to an embodiment of the present invention of FIGS. 1 and 2.
Figure 3B:
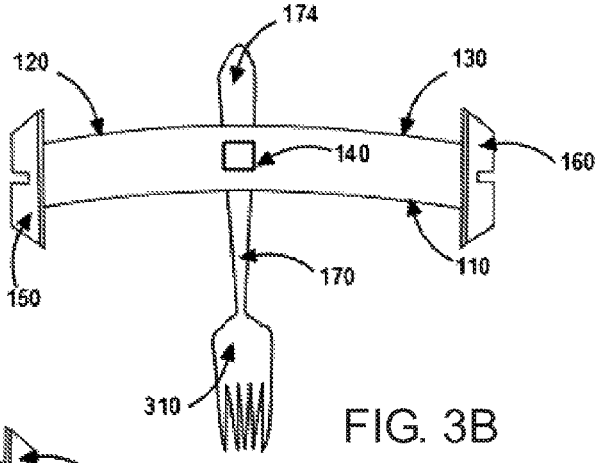
Figure 3C:
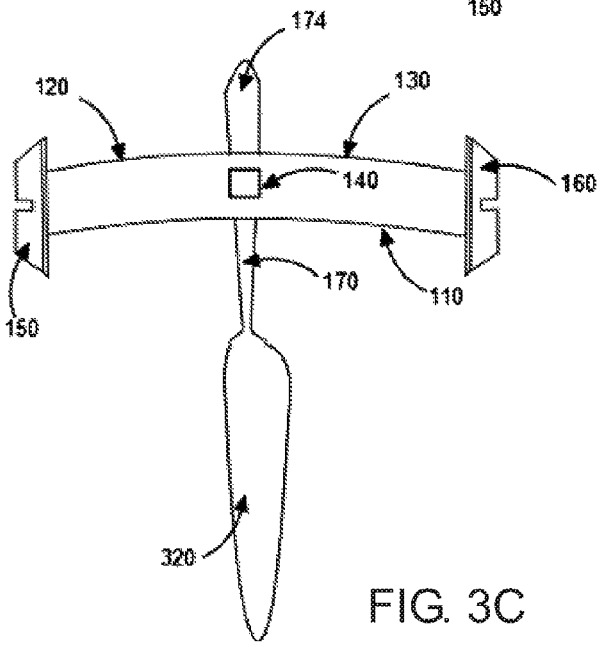
FIG. 3C is a perspective view illustrating a cylindrical handle extender assembly coupled to a handle of a knife of the cylindrical handle extender removably-coupleable to a utensil according to an embodiment of the present invention of FIGS. 1 and 2.

Referring now to FIGS. 3A-3C showing various perspective views illustrating cylindrical handle extender assembly 102 coupled to various utensils 170 of cylindrical handle extender removably-coupleable to a utensil system 100 according to an embodiment of the present invention of FIGS. 1 and 2.

Utensil 170 may comprise spoon 300 as shown in FIG. 3A. Utensil 170 may comprise fork 310 as shown in FIG. 3B. Utensil 170 may comprise knife 320 as shown in FIG. 3C. Upon reading this specification, it should be appreciated that, under appropriate circumstances, considering such issues as user preferences, design preference, structural requirements, marketing preferences, cost, available materials, technological advances, etc., other utensil arrangements such as, for example, kitchenware, cookware, bakeware, etc., may be sufficient.

Figure 4A:
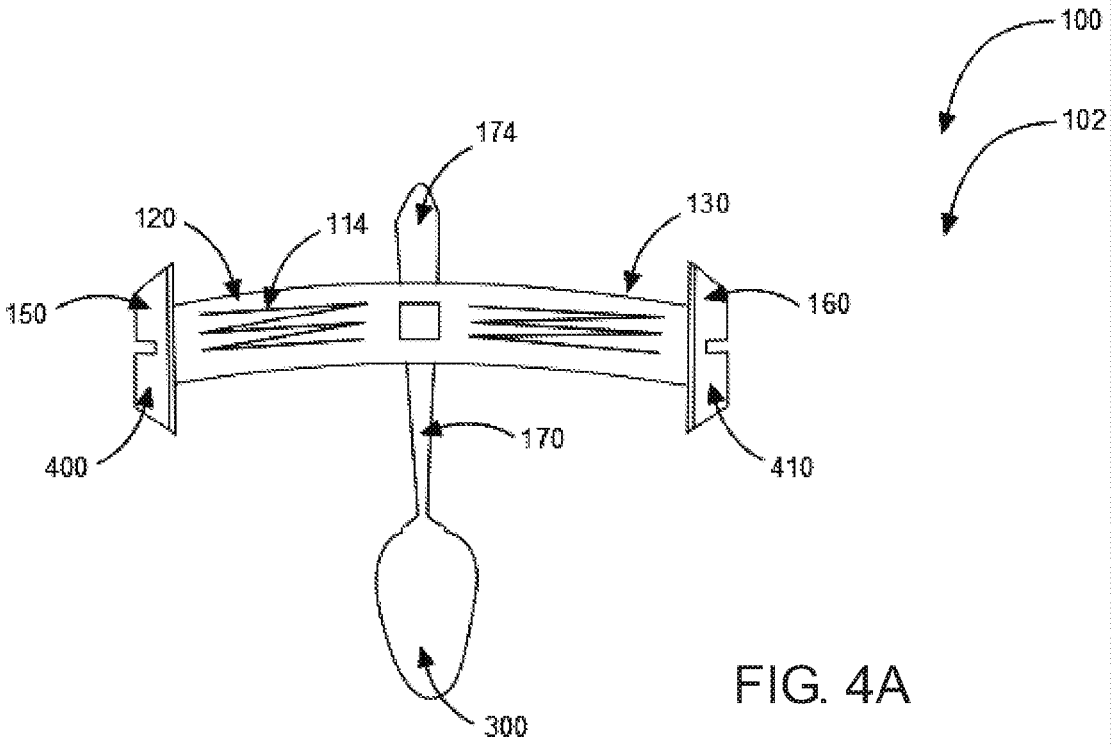
FIG. 4A is a perspective view illustrating a circular shaped first end cap and a circular shaped second end cap of the cylindrical handle extender removably-coupleable to the utensil according to an embodiment of the present invention of FIG. 1.

Referring now to FIG. 4A, a perspective view illustrating circular shaped 400 first end cap 150 and cylindrical shaped 410 second end cap 160 of cylindrical handle extender removably-coupleable to a utensil system 100 according to an embodiment of the present invention of FIG. 1.

First end cap 150 is removably-coupleable to first end 120 to provide a smooth surface for first hand 184 of user 180 to grasp cylindrical handle extender assembly 102. First end cap 150 may be circular-shaped 400 to provide hand-contouring of first hand 184 and second hand 186 while in in-use condition for ease of use. Second end cap 160 is removably-coupleable to second end 130 to provide a smooth surface for second hand 186 of user 180 to grasp cylindrical handle extender assembly 102. Second end cap 160 may also be circular-shaped 410 to provide hand-contouring of first hand 184 and second hand 186 while in in-use condition.

Figure 4B:
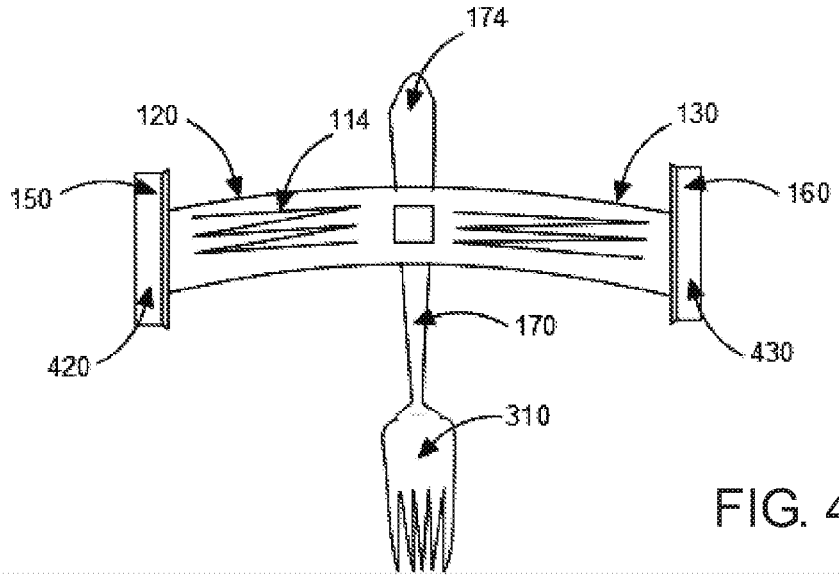
FIG. 4B is a perspective view illustrating a square shaped first end cap and a square shaped second end cap of the cylindrical handle extender removably-coupleable to the utensil according to an embodiment of the present invention of FIG. 1.

Referring now to FIG. 4B, a perspective view illustrating square shaped 420 first end cap 150 and square shaped 430 second end cap 160 of cylindrical handle extender removably-coupleable to a utensil system 100 according to an embodiment of the present invention of FIG. 1.

First end cap 150 may also be square-shaped 420 to provide hand-contouring of first hand 184 and second hand 186 while in in-use condition 106. Second end cap 160 may also be square-shaped 430 to provide hand-contouring of first hand 184 and second hand 186 while in in-use condition. Certain users may prefer this embodiment to provide gripping means.

Cylindrical handle extender removably-coupleable to a utensil system 100 according to an embodiment of the present invention of FIGS. 1-4C may comprise a kit (not shown). The kit may comprise the following parts: a plurality of cylindrical handle extender assemblies 102 in various colors, designs, lengths, and having various sized radial slits 140; and a set of user-instructions. The kit has instructions such that functional relationships are detailed in relation to the structure of the invention (such that the invention can be used, maintained, or the like in a preferred manner).

Cylindrical handle extender removably-coupleable to a utensil system 100 may be manufactured and provided for sale in a wide variety of sizes and shapes for a wide assortment of applications. Upon reading this specification, it may be appreciated that, under appropriate circumstances, considering such issues as design preference, user preferences, marketing preferences, cost, structural requirements, available materials, technological advances, etc., other kit contents or arrangements such as, for example, including more or less components, customized parts, parts may be sold separately, etc., may be sufficient.

Figure 5:
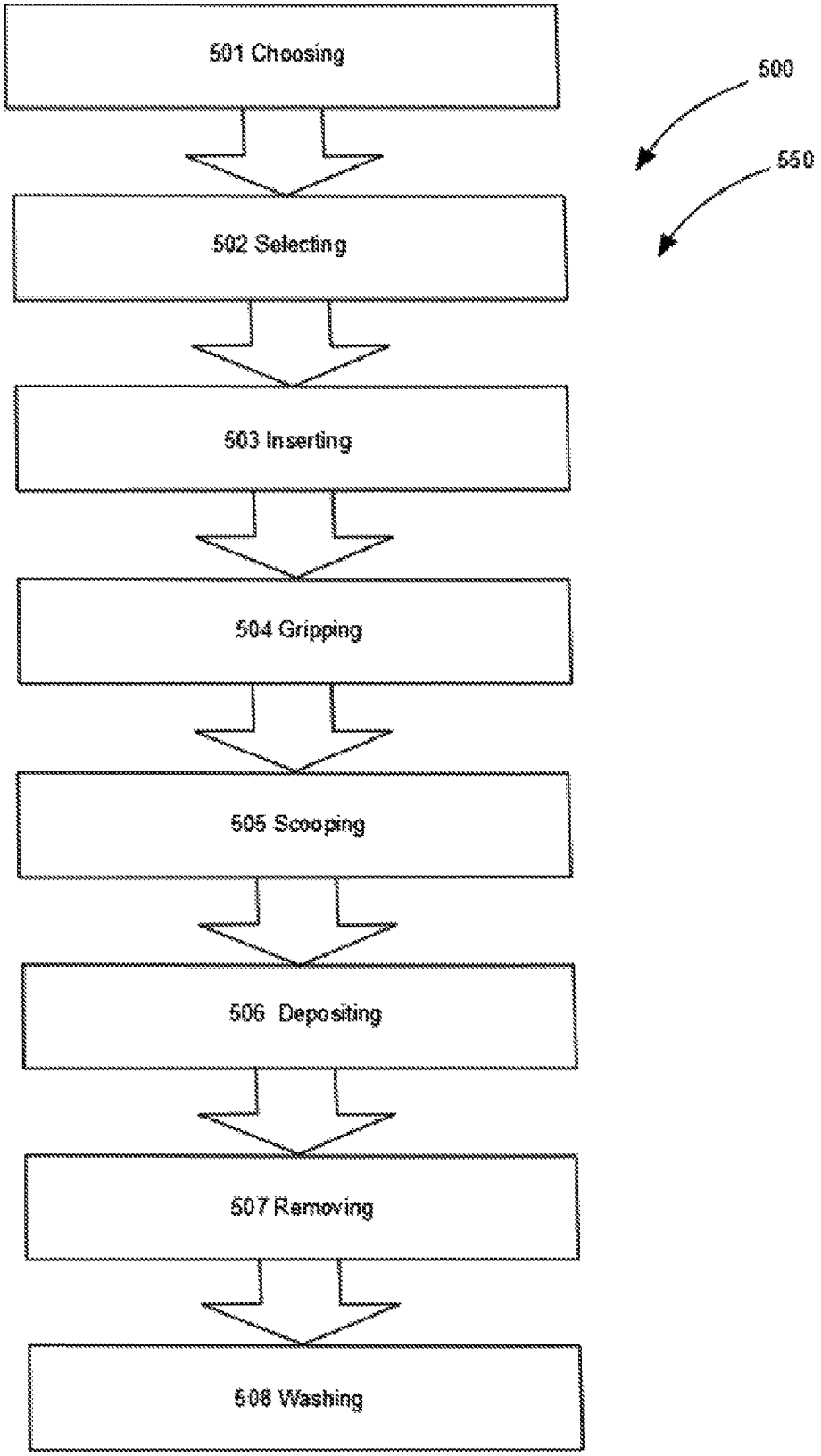
FIG. 5 is a flowchart illustrating a method of use for the cylindrical handle extender removably-coupleable to the utensil according to an embodiment of the present invention of FIGS. 1-4B.

Referring now to FIG. 5. showing flowchart 550 illustrating a method of use 500 for cylindrical handle extender removably-coupleable to a utensil system 100 according to an embodiment of the present invention of FIGS. 1-4C.

A method of using (at least herein enabling method of use 500) cylindrical handle extender removably-coupleable to a utensil system 100 may comprise the steps of: step one 501 user 180 choosing cylindrical handle extender assembly 102; step two 502 user 180 selecting utensil 170 to be used; step three 503 inserting handle 174 of utensil 170 through radial slit 140 thereby temporarily securing cylindrical handle extender assembly 102 in place; step four 504 gripping cylindrical handle extender assembly 102 with at least one hand; step five 505 user 180 scooping up at least one food item; step six 506 user 180 depositing at least one food item into mouth region 182; step seven 507 removing cylindrical handle extender assembly 102 from handle 174 of utensil 170 once finished for future use; and step eight 508 washing cylindrical handle extender assembly 102 for a future use.

It should be noted that the steps described in the method of use can be carried out in many different orders according to user preference. The use of "step of" should not be interpreted as "step for", in the claims herein and is not intended to invoke the provisions of 35 U.S.C. §112, 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A cylindrical handle extender removably-coupleable to a utensil comprising:

a cylindrical extender member having, a first end;

a second end;

a slit along a length of said cylindrical extender member, said cylindrical extender member with an inner-volume defined by an interior surface, said cylindrical extender member able to be removably-coupled repeatedly to and from a handle of said utensil;

a first end cap; and a second end cap;

wherein said cylindrical handle extender comprises said cylindrical extender member removably-coupleable to said utensil;

wherein said cylindrical extender member is removably-coupleably to said handle of said utensil via placement in said slit;

wherein said handle of said utensil is dimensioned to fit into said slit and is temporarily secured in place thereby limiting unwanted displacement via friction fitting;

wherein said first end cap is removably-coupleable to said first end to provide a smooth surface for a first hand of a user to grasp said cylindrical extender member;

wherein said second end cap is removably-coupleable to said second end to provide a smooth surface for a second hand of said user to grasp said cylindrical extender member; and wherein said cylindrical extender member enables said user to grasp said utensil laterally with said first hand and said second hand and is as such suitable for use by said user who suffers from disabilities wherein grip strength of said first hand and said second hand are diminished and poorly coordinated.

2. The cylindrical handle extender removably-coupleable to a utensil of claim 1 wherein said utensil comprises a spoon.

3. The cylindrical handle extender removably-coupleable to a utensil of claim 1 wherein said utensil comprises a fork.

4. The cylindrical handle extender removably-coupleable to a utensil of claim 1 wherein said utensil comprises a knife.

5. The cylindrical handle extender removably-coupleable to a utensil of claim 1 wherein said cylindrical extender member comprises hard plastic for suitable strength and durability.

6. The cylindrical handle extender removably-coupleable to a utensil of claim 1 wherein said cylindrical extender member is resilient to contour to said first hand and said second hand of said user while grasping said cylindrical extender member in an in-use condition.

7. The cylindrical handle extender removably-coupleable to a utensil of claim 6 wherein said cylindrical extender member comprises rubber.

8. The cylindrical handle extender removably-coupleable to a utensil of claim 7 wherein said rubber comprises nitrile rubber tubing.

9. The cylindrical handle extender removably-coupleable to a utensil of claim 1 wherein said slit is able to deform to an aperture through said cylindrical extender member to permit said handle of said utensil to fit through said slit and temporarily be secured approximately halfway down said handle.

10. The cylindrical handle extender removably-coupleable to a utensil of claim 1 where said first end cap is circular-shaped to provide hand-contouring of said first hand and said second hand while in a in-use condition for ease of use.

11. The cylindrical handle extender removably-coupleable to a utensil of claim 1 where said second end cap is circular-shaped to provide hand-contouring of said first hand and said second hand while in a in-use condition.

12. The cylindrical handle extender removably-coupleable to a utensil of claim 1 where said first end cap is square-shaped to provide hand-contouring of said first hand and said second hand while in a in-use condition.

13. The cylindrical handle extender removably-coupleable to a utensil of claim 1 where said second end cap is square-shaped to provide hand-contouring of said first hand and said second hand while in a in-use condition.

14. The cylindrical handle extender removably-coupleable to a utensil of claim 1 wherein said cylindrical extender member provides a large surface area and gripping surface laterally-positionable to a mouth of said user, comfortably positioning for said user who is handicapped.

* * * * *